United States Patent [19]

Strutz, Jr. et al.

[11] Patent Number: 4,485,736

[45] Date of Patent: Dec. 4, 1984

[54] INK-DISPENSING SYSTEM AND METHOD FOR SILK-SCREEN PRINTING HAVING SQUEEGEE STROKE MOVEMENT COUNTER

[76] Inventors: Carl Strutz, Jr.; Frank C. Strutz, both of R.D. 2, Camp Trees Rd., Mars, Pa. 16046; Rome R. Rudolph, deceased, late of Gibsonia, Pa.; by Kathleen Rudolph, executrix, 4113 Lee Rd., Gibsonia, Pa. 15044

[21] Appl. No.: 526,637

[22] Filed: Aug. 26, 1983

[51] Int. Cl.[3] ..... B41M 1/12

[52] U.S. Cl. ..... 101/129; 101/123; 222/1; 222/52; 118/46

[58] Field of Search ..... 101/129, 127, 127.1, 101/128, 128.1, 114–115, 123, 124, 125; 222/52, 1; 118/697, 46; 401/261, 264

[56] References Cited

U.S. PATENT DOCUMENTS

| | | | |
|---|---|---|---|
| 3,252,411 | 5/1966 | Black | 101/129 X |
| 3,742,902 | 7/1973 | Heston, Jr. | 101/129 |
| 3,779,161 | 12/1973 | Tatebe | 101/123 |
| 3,859,918 | 1/1975 | Dargols | 101/127.1 |
| 3,890,896 | 6/1975 | Zimmer | 101/123 |
| 3,896,722 | 7/1975 | Farrow | 101/115 |
| 4,043,683 | 8/1977 | Costa et al. | 401/264 |
| 4,248,150 | 2/1981 | Lala | 101/123 |
| 4,398,462 | 8/1983 | Okano | 101/127 |

FOREIGN PATENT DOCUMENTS

| | | | |
|---|---|---|---|
| 3034805 | 3/1982 | Fed. Rep. of Germany | 101/129 |
| 2452380 | 11/1980 | France | 101/114 |

*Primary Examiner*—E. H. Eickholt

*Attorney, Agent, or Firm*—Thomas H. Murray; Clifford A. Poff

[57] ABSTRACT

Disclosed is a system for dispensing ink to a silk screen for printing thereby. A squeegee is reciprocated relative to the silk screen and each cycle of movement provides an air pulse to a counter. The counted pulses are compared with a preset number of pulses based on the actual amount of ink which is used during the printing operations. When the counted pulses are counted up to the preset number, a control signal is fed to a valve to operate a piston and cylinder assembly which is coupled to a piston to force a measured quantity of ink from a cylinder. The cylinder is fed with a supply of ink from an ink pot. A check valve in the bottom of the cylinder opens only when the ink in the cylinder is pressurized by the piston. The measured quantity of ink dispensed from the cylinder is delivered by a conduit to the silk screen.

14 Claims, 3 Drawing Figures

Figure 1:
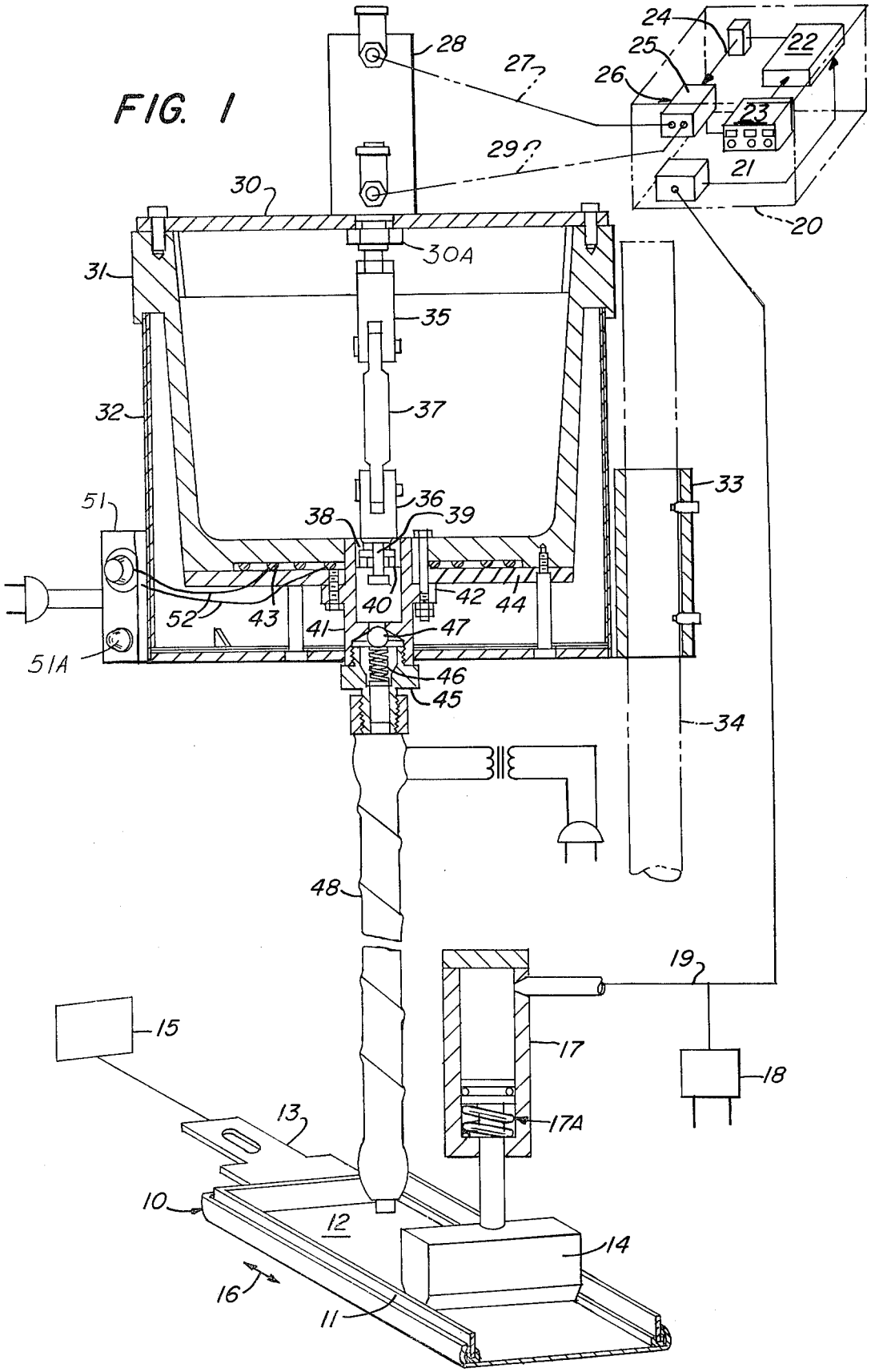

INK-DISPENSING SYSTEM AND METHOD FOR SILK-SCREEN PRINTING HAVING SQUEEGEE STROKE MOVEMENT COUNTER

BACKGROUND OF THE INVENTION

This invention relates to dispensing ink at intervals selected to correspond to the amount of ink that is forced through a silk screen during a period of operation by a squeegee for printing. More particularly, the present invention relates to a system and method capable of automatic operation to dispense a predetermined quantity of ink that may comprise thermoplastic paint maintained in a liquid state in a reservoir through a conduit in response to a control signal generated by counting up a predetermined number of pulses corresponding to operations of a squeegee used to pass through a silk screen for printing operations.

It is common practice to mark objects, particularly containers such as bottles, by a silk-screen printing process wherein a screen made of silk or wire mesh has its surface rendered non-porous to ink or paint except in those areas which delineate the marking. The ink can pass through the porous areas of the screen onto any surface in contact with the screen. A frame is used to hold the screen so that a squeegee pressed against one surface of the screen will force ink through the porous areas as the squeegee is moved along the screen for each printing operation. For a printing operation, it is known in the art to use solvent-based ink or thermoplastic paint which is maintained in a liquid state by resistively heating steel-wire gauze used to form the silk screen. The thermoplastic paint is manually fed in solid form onto the heated surface of the screen where it is liquefied before printing. There is a need, however, to dispense ink or paint to the silk screen in such a manner that a sufficient quantity of ink or paint is always present for printing operations. Hand feeding paint or manual control of the flow of ink or paint to the silk screen requires careful monitoring by an operator to avoid depletion of the paint in the screen or overfilling the ink supply. It is not acceptable, for example, to dispense ink at a given flow rate or at predetermined intervals of time since the printing operation may be carried out on an intermittent or irregular time basis.

SUMMARY OF THE INVENTION

It is an object of the present invention to provide a method and apparatus for dispensing ink for silk-screen printing at intervals selected to correspond to the usage of a predetermined quantity of ink.

It is a further object of the present invention to provide a method and system for dispensing ink in an automatic manner in which pulses are counted up to a preselected number to correspond to the quantity of ink forced through a silk screen by strokes of a squeegee or screen to provide a signal for dispensing a measured quantity of ink to the screen for continued printing operations.

More particularly, according to one aspect of the present invention there is provided an ink-dispensing system for silk-screen printing wherein the system includes ink-measuring means having an ink-discharge port and an ink-entry port, the ink-measuring means including a piston slideable in a cylinder to force a predetermined quantity of ink from the cylinder through the ink-discharge port, a conduit including means responsive to the pressurization of ink in the cylinder for delivering ink to a silk screen, means for supplying ink through the ink-entry port into the cylinder, actuator means for reciprocating the piston in the cylinder, means for generating pulse signals each corresponding to the discharge of ink through a silk screen by relative movement between the screen and a squeegee, and controller means responsive to the pulses for operating the actuator means.

In the method of the present invention, the steps include, filling an ink-measuring chamber for a predetermined quantity of ink, counting the strokes corresponding to movement of a squeegee relative to a silk screen, producing a control signal in response to a preselected number of counted strokes by the squeegee, operating an actuator in response to the control signal to force the quantity of ink in the measured cylinder into a conduit, and conducting the ink in the conduit onto a silk screen for printing.

Figure 2:
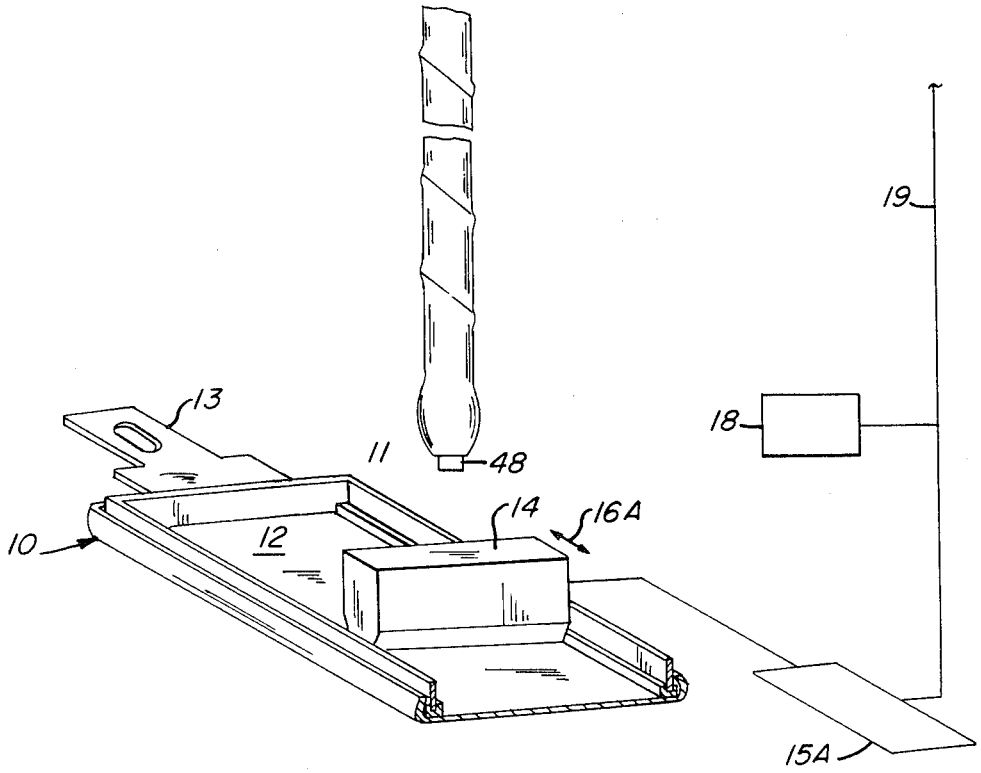
Figure 3:
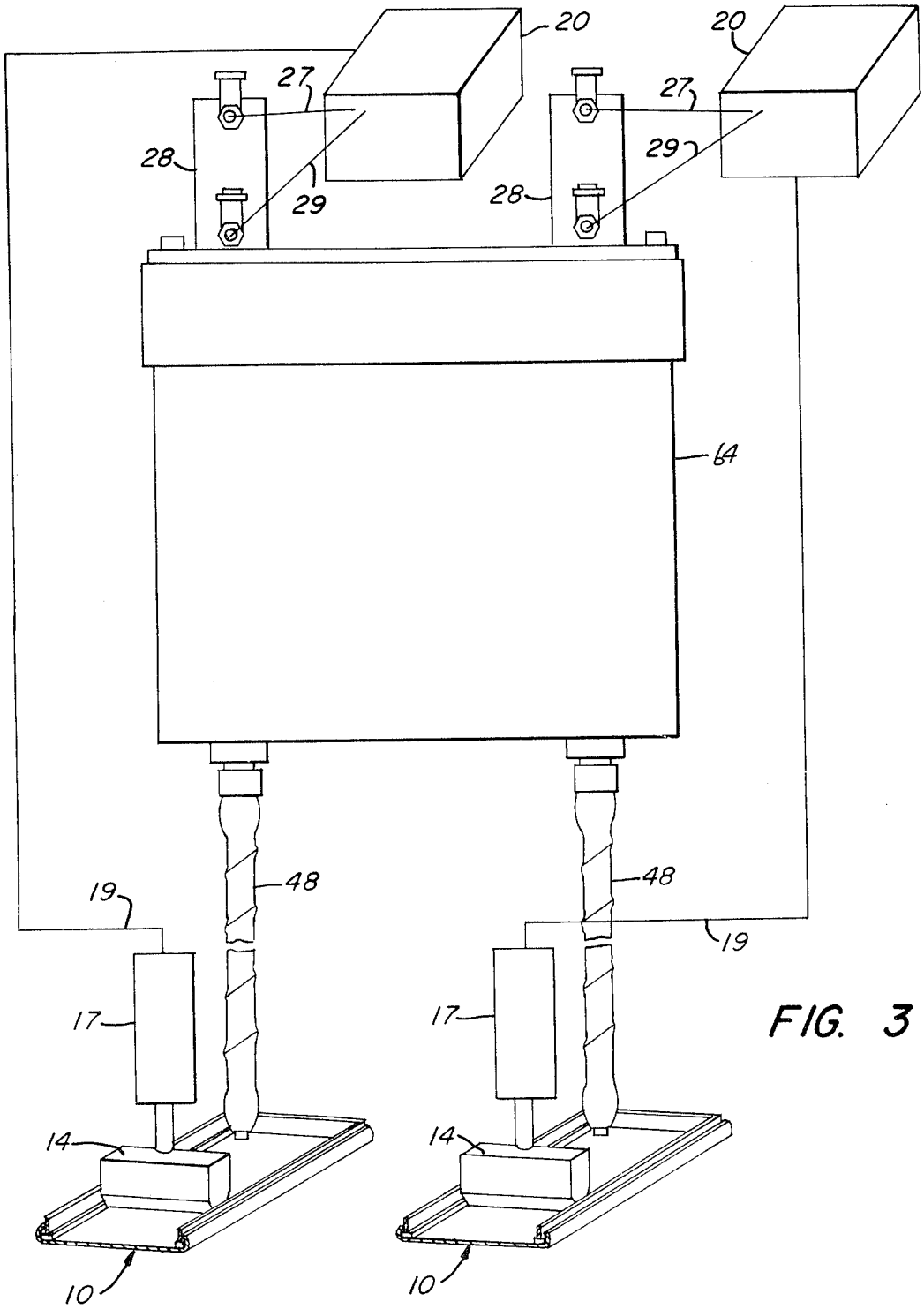

Other aspects as well as features and advantages of the present invention will be apparent from the following description of the present invention when read in light of the accompanying drawings, in which:

FIG. 1 illustrates one embodiment of an ink-dispensing system, part of which is shown by an elevational view in cross section;

FIG. 2 schematically illustrates a modified form of a squeegee drive system; and FIG. 3 illustrates a second embodiment of the present invention.

In FIG. 1 of the drawings, there is illustrated a silk-screen assembly 10 which is part of a printing machine, per se, well known in the art and used to support the screen assembly and feed articles for printing thereon. As is known in the art, the silk-screen assembly 10 includes a rectangular frame 11 on which metal gauze 12 is attached for support thereby. While the present invention is applicable to printing with a solvent-based ink, it is equally useful for printing with thermoplastic paint and for this purpose the screen is heated by a low-voltage current to prevent premature freezing of liquefied thermoplastic paint fed to the screen. The embodiments of the invention shown in the drawings are designed for printing with thermoplastic paint and include heater means for liquefying thermoplastic paint and maintaining the paint in a liquid state throughout the printing operation. It is to be understood, however, that the heaters can be eliminated and solvent-based paint used without departing from the spirit of the present invention.

Reference numeral 13 identifies one of two support arms that extend from opposite ends of the frame 11 for support by the printing machine while attached to a suitable source of low voltage power for resistive heating of the screen 12. A squeegee 14 is reciprocated toward and away from the screen in the frame whereby a knife-edge at the lower edge moves into contact with the screen to force paint through open spaces in the screen. These open spaces define the desired pattern which is to be printed on the article. The open spaces are conventionally formed by an emulsion which solidifies on the screen except in areas selected to form the desired pattern.

A drive 15, such as a piston and cylinder assembly, is part of the printing machine and mechanically connected to the screen to reciprocate the screen relative to the sequence as indicated by the double-headed arrow 16. As the screen moves from a rest position, the squeegee 14 is pressed against the screen to force it into contact with a workpiece by a piston and cylinder assembly 17. A source of pressurized air is connected through a control 18 by a line 19 to the cylinder end of the piston and cylinder assembly to extend the piston rod against the force of a return spring 17A. When the screen has moved to the end of its path of travel, air is exhausted from the piston and cylinder assembly 17, causing the squeegee to retreat from contact with the screen by the force of spring 17A on the piston. Air supply line 19 is also connected to a control console 20. An air pulse occurs in line 19 each time the squeegee is reciprocated into and out of contact with the screen. In FIG. 2, where the same reference numerals have been applied to parts that are the same as the parts identified in FIG. 1, an air pulse occurs in line 19 each time the squeegee 14 is reciprocated back and forth along the screen 12. The screen in FIG. 2 is not reciprocated. Ink is forced through the screen onto a workpiece as the squeegee and workpiece move or rotate together. The lower surface of the screen is pressed into line contact by the squeegee. A drive 15A is mechanically connected to the squeegee to reciprocate the squeegee along the screen as indicated by the double-headed arrow 16A. Line 19 and control 18 supply air to the drive 15A. Each time line 19 is pressurized with air, an air pulse is detected and registered as one pulse on a counter 21. The counter counts up the number of pulses and delivers a signal to a comparator 22 which also receives a preset signal generated by a manually-adjustable dial indicator 23. The indicator preferably has a three-digit, manually-selectable input so that any number up to 999 can be preselected on the indicator and a corresponding signal transmitted to the comparator 22. The comparator produces a control signal in line 24 when the counter 21 counts up to the preselected number of pulses as selected by the indicator 23. The control signal delivered by line 24 energizes a time delay which sends a signal to a solenoid to operate an air-operated air valve 25. Valve 25 receives a supply of air from line 26 and delivers an air supply by line 27 to the rod end of a piston and cylinder assembly 28. This forces the piston through its stroke along the cylinder. The time delay holds the signal to the solenoid for a period of time, e.g., 10 seconds. When deactivated, the solenoid deenergizes the air-operated air valve 25 whereupon a second air supply is fed from valve 25 by line 29 to return the piston to its retracted position in the cylinder.

The piston and cylinder assembly 28 is mounted onto a bracket 30 by a nut 30A received on a threaded tube projecting from the rod end of the piston and cylinder assembly. The bracket is secured by fasteners to the top of an ink pot 31. The ink pot is, in turn, supported by a housing 32 that is carried by a bracket 33 on a support post 34. The rod end of the piston and cylinder assembly 28 is secured to a clevis 35 which is coupled to a clevis 36 by a connecting rod 37. The clevis 36 has a conical seat surface that can move into sealing engagement with a conical seat surface on an annular piston 38. Projecting from the clevis 36, beyond the conical surface thereof, is a guide rod 39 engaged with a guide web section 40 forming part of the piston 38. The projecting end of the guide rod 39 has a retainer cap thereon to maintain the guide rod engaged with the piston during reciprocating movement of the piston along a cylinder 41. The cylinder has a flange 42 by which the cylinder is secured in an opening formed in the bottom of the ink pot 31. A recess in the bottom of the ink pot receives a heating element 43. A cover plate 44 retains the heating element against the bottom of the ink pot and bolts are passed through the bottom of housing 32 to retain the cover plate 44 against the ink pot and provides support for the latter in the housing.

The bottom wall of the cylinder 41 is provided with a passageway that extends to a counterbored end portion wherein a fitting 45 is threadedly received and supports a spring 46 to urge a check valve ball 47 into a position where it normally closes the opening in the bottom of the cylinder. In this way, a quantity of paint can flow into the cylinder from the ink pot beyond the seat surface on clevis 36. The quantity of paint in the cylinder is isolated from the volume of paint in the ink pot when the conical surface on the end of clevis 36 seats against the conical surface of the piston 38. This occurs by downward movement of the piston of the piston and cylinder assembly 28. Continued movement of the piston pressurizes the paint in the cylinder to such an extent that the ball 47 is displaced to open the annular opening in the bottom of the cylinder and permit discharge of the paint from the cylinder into a conduit formed by a discharge tube 48. The tube 48 is provided with a length sufficient to extend to the silk-screen printing assembly 10. When thermoplastic paint is used, then the discharge tube 48 is provided with an outer wrapping containing a low-voltage heater that is connected by leads 49 to an electrical transformer. The transformer, as shown, is connected to a suitable power supply and may be conveniently located in the control console 20. A housing 51 encloses a rheostat that is coupled by lines 52 to the heating element 43 for controlling the temperature to which the paint in pot 31 is elevated. Housing 51 also supports an indicator light 51A that is connected in an electrical circuit with the rheostat to indicate when power is supplied to the heating element 43.

The dispensing of ink or thermoplastic paint for printing with a silk screen according to the present invention is carried out by initially establishing the number of printing operations that can be carried out with a measured quantity of ink that is dispensed from the measuring cylinder 41 to the silk-screen printing assembly. The number of printing operations varies with the area of the open spaces in the silk screen. Thus, for example, if the measured quantity of ink is sufficient for 100 printings of the indicia defined by the open spaces on a given silk screen then it can be established, for example, that the same quantity of ink will be sufficient for 200 printings of indicia on another silk screen having one-half the open area of the first silk screen. In this latter instance, the dial indicator 23 will be set for 200 whereupon as the two-hundredth printing operation occurs, the counter 21 will enable the comparator to provide a control signal in line 24; thus actuating valve 25. Valve 25, as previously described, operates piston and cylinder assembly 28 through one stroke by which a measured quantity of ink in cylinder 41 is forced therefrom by opening of check valve ball 47. The measured quantity of ink is conducted along conduit 48 to the screen. A predetermined number of air pulses forms the basis for automatic dispensing of ink at intervals that are not time-dependent. For convenience, one air pulse is selected to equal one squeegee stroke and thereby equals one number on the counter 23. The counter can be preset at any number which is determined by the size of the imprint and thus the ink which is needed. It is preferable to provide a manual override control to operate the ink pump without affecting the setting of the counter to carry out the start-up operation. Such a manual override will provide a control signal in line 24 to operate valve 25.

In FIG. 3, there is illustrated an embodiment of the present invention wherein two silk screens 10 receive measured quantities of ink from one of two tubes 48. The screens or squeegees associated therewith are reciprocated as previously described. Air pulses occur in each of two lines 19 which are separately connected to two controls 20 that operate piston-driven pumps located in a single ink pot 64. The ink pot 64 is larger than ink pot 31 but otherwise constructed in the same manner as previously described.

Although the invention has been shown in connection with certain specific embodiments, it will be readily apparent to those skilled in the art that various changes in form and arrangement of parts may be made to suit requirements without departing from the spirit and scope of the invention.

We claim as our invention:

1. A method to dispense ink for printing with a silk screen, said method including the steps of:

filling an ink-dispensing measuring chamber with a predetermined quantity of ink, counting the strokes corresponding to relative displacement between a squeegee and said silk screen, producing a control signal in response to a preestablished number of counted strokes by the squeegee, operating an actuator in response to said control signal to force the quantity of ink in said measuring cylinder into a conduit, and conducting the ink in said conduit onto a silk screen for printing.

2. The method according to claim 1 including the further steps of using valves to close ink-entry and discharge ports at opposite ends of said measuring chamber before forcing ink therefrom, and opening the valve at said ink-entry port under the pressure imposed on the ink in the measuring chamber by said actuator.

3. The method according to claim 1 including the further step of heating a container to liquefy a supply of ink for said step of filling an ink-measuring chamber.

4. The method according to claim 3 including the further step of heating a conduit for said step of conducting ink.

5. The method according to claim 1 including the further step of adjustably selecting the preestablished number of counted strokes according to the ink-passage area in the silk screen.

6. An ink-dispensing system for silk-screen printing, said system including the combination of:

ink-measuring means having an ink-discharge port and an ink-entry port, said ink-measuring means including a piston slideable in a cylinder to force a predetermined quantity of ink from the cylinder through said ink-discharge port, a conduit including means responsive to the pressurization of ink in said cylinder for delivering ink to a silk screen, means for supplying ink through said ink-entry port into said cylinder, actuator means for reciprocating said piston in said cylinder, means for generating pulse signals each corresponding to the discharge of ink through a silk screen by a squeegee, and controller means responsive to said pulses for operating said actuator means.

7. The system according to claim 6 wherein said means for supplying ink includes a reservoir with means to heat ink therein.

8. The system according to claim 7 further including a controller for said means to heat ink in the reservoir.

9. The system according to claim 7 further including heater means for said conduit.

10. The system according to claim 6 wherein said piston comprises an annular bushing slideable in said cylinder and having a valve seat communicating with an ink passageway forming said ink-entry port.

11. The system according to claim 10 further including a connector having a valve surface at one end to engage said valve seat, and coupler means at the other end for interconnection with said actuator means.

12. The system according to claim 11 wherein said connector includes a guide pin section slideably supported by said annular bushing for aligning said valve surface and said valve seat.

13. The system according to claim 6 wherein said actuator means includes a piston and cylinder assembly.

14. The system according to claim 6 wherein said controller means includes a counter to produce a control signal by counting up a predetermined number of pulses produced by said means for generating pulses, means for selectively establishing said predetermined number of pulses, and a control valve responsive to said control signal for operating said actuator means.

* * * * *